US011585347B2

(12) United States Patent
Joly et al.

(10) Patent No.: US 11,585,347 B2
(45) Date of Patent: Feb. 21, 2023

(54) MIXED-FLOW COMPRESSOR CONFIGURATION FOR A REFRIGERATION SYSTEM

(71) Applicant: Carrier Corporation, Palm Beach Gardens, FL (US)

(72) Inventors: Michael M. Joly, Palm Beach Gardens, FL (US); Vishnu M. Sishtla, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 45 days.

(21) Appl. No.: 17/254,510

(22) PCT Filed: May 15, 2020

(86) PCT No.: PCT/US2020/033105
§ 371 (c)(1),
(2) Date: Dec. 21, 2020

(87) PCT Pub. No.: WO2020/242788
PCT Pub. Date: Dec. 3, 2020

(65) Prior Publication Data

US 2021/0123444 A1 Apr. 29, 2021

Related U.S. Application Data

(60) Provisional application No. 62/855,352, filed on May 31, 2019.

(51) Int. Cl.
*F04D 17/02* (2006.01)
*F04D 17/06* (2006.01)
(Continued)

(52) U.S. Cl.
CPC ..... *F04D 17/025* (2013.01); *F04D 17/06* (2013.01); *F04D 21/00* (2013.01); *F04D 29/284* (2013.01); *F04D 29/442* (2013.01); *F04D 29/444* (2013.01)

(58) Field of Classification Search
CPC ..... F04D 29/444; F04D 21/00; F04D 17/10
See application file for complete search history.

(56) References Cited

U.S. PATENT DOCUMENTS 2,648,493 A 8/1953 Stalker
2,819,837 A * 1/1958 Loeb ..... F04D 21/00 415/181
(Continued)

FOREIGN PATENT DOCUMENTS

CH 250467 8/1947
CN 1662734 A 8/2005
(Continued)

OTHER PUBLICATIONS

International Preliminary Report on Patentability for International Patent Application No. PCT/US2020/033105 completed on Nov. 16, 2021.
(Continued)

*Primary Examiner* — Woody A Lee, Jr.
*Assistant Examiner* — Brian O Peters
(74) *Attorney, Agent, or Firm* — Carlson, Gaskey & Olds, P.C.

(57) ABSTRACT

A centrifugal compressor includes a casing. An impeller is arranged within the casing. The impeller is rotatable about an axis. A diffuser section is arranged within the casing. The diffuser section is positioned axially downstream from an outlet of the impeller and includes a forward portion fixed relative to the impeller and an aft portion distinct from the forward portion.

20 Claims, 3 Drawing Sheets

(51) Int. Cl.

| | |
|---|---|
| ***F04D 21/00*** | (2006.01) |
| ***F04D 29/28*** | (2006.01) |
| ***F04D 29/44*** | (2006.01) |

(56) References Cited

U.S. PATENT DOCUMENTS

| | | | | |
|---|---|---|---|---|
| 2,898,031 | A * | 8/1959 | Voigt | F04D 29/441<br>415/181 |
| 3,868,196 | A * | 2/1975 | Lown | F04D 27/0215<br>415/62 |
| 2014/0271173 | A1* | 9/2014 | Bryan | F04D 17/10<br>415/182.1 |

FOREIGN PATENT DOCUMENTS

| | | | |
|---|---|---|---|
| CN | 109779932 | A | 5/2019 |
| EP | 0349051 | | 1/1990 |
| FR | 2633336 | A1 | 12/1989 |
| GB | 695948 | | 8/1953 |
| WO | 2013141912 | | 9/2013 |
| WO | 2019092358 | | 5/2019 |

OTHER PUBLICATIONS

International Search Report and Written Opinion for International Application No. PCT/US2020/033105 dated Aug. 19, 2020.

* cited by examiner

MIXED-FLOW COMPRESSOR CONFIGURATION FOR A REFRIGERATION SYSTEM

CROSS-REFERENCE TO RELATED APPLICATION

This application claims priority to U.S. Provisional Application No. 62/855,352 filed on May 31, 2019.

TECHNICAL FIELD

The present disclosure relates generally to mixed-flow compressors, and more specifically to a diffuser configuration for a mixed-flow compressor.

BACKGROUND

Rotary machines, such as compressors, are commonly used in refrigeration and turbine applications. One example of a rotary machine used in refrigeration systems includes a centrifugal compressor having an impeller fixed to a rotating shaft. Rotation of the impeller increases a pressure and/or velocity of a fluid or gas moving across the impeller.

In applications using a high pressure refrigerant, the compressor can have a supersonic outlet flow. Existing compressors use a tandem vane set protruding from a fixed diffuser to diffuse the high-Mach number flow with the first vane set and achieve conventional subsonic diffuser flow via turning with the second vane set. In existing systems it can be difficult to mitigate the total pressure across the vane used to condition the flow to a conventional flow, and this in turn can lead to strong corner separation at the vane roots of the second vane set.

SUMMARY OF THE INVENTION

In one exemplary embodiment a centrifugal compressor includes a casing, an impeller arranged within the casing, the impeller being rotatable about an axis, and a diffuser section arranged within the casing, the diffuser section being positioned axially downstream from an outlet of the impeller, and including a forward portion fixed relative to the impeller and an aft portion.

In another example of the above described centrifugal compressor a radially inward boundary of the forward portion of the diffuser section includes a set of vanes protruding radially outward, and being configured to reduce a flow from supersonic to subsonic speeds.

In another example of any of the above described centrifugal compressors the set of vanes are configured to reduce a Mach number of the flow by at least 50%.

In another example of any of the above described centrifugal compressors the set of vanes are configured to reduce the Mach number to a number in the range of 0.4 to 0.8 Mach.

In another example of any of the above described centrifugal compressors the aft portion is defined by an absence of vanes.

In another example of any of the above described centrifugal compressors a radial height of the diffuser section is constant along the forward portion of the diffuser section.

In another example of any of the above described centrifugal compressors a radial height of the diffuser section increases along at least a portion of the aft portion.

In another example of any of the above described centrifugal compressors a radially inner wall of the diffuser section converges toward an axis defined by the diffuser section along at least a portion of the aft portion.

In another example of any of the above described centrifugal compressors a radially outer wall of the diffuser section diverges away from the axis defined by the diffuser section along the portion of the aft portion.

In another example of any of the above described centrifugal compressors a radially outer wall of the diffuser section diverges away from the axis defined by the diffuser section along the portion of the aft portion.

In another example of any of the above described centrifugal compressors the radial height increases along at least the portion of the aft portion at a constant rate.

In another example of any of the above described centrifugal compressors the radial height increases along at least the portion of the aft portion at a varying rate.

In another example of any of the above described centrifugal compressors the centrifugal compressor is a mixed-flow compressor.

In one exemplary embodiment a centrifugal compressor includes a casing, an impeller arranged within the casing, the impeller being rotatable about an axis, and a diffuser section arranged within the casing, the diffuser section being positioned axially downstream from an outlet of the impeller, and including a forward portion having a constant radial height, and an aft portion having a radial height increasing along a direction of flow.

In another example of the above described centrifugal compressor the aft portion is freely rotating relative to the forward portion and the impeller.

In another example of any of the above described centrifugal compressors the forward portion is fixed relative to the impeller.

In another example of any of the above described centrifugal compressors the aft portion includes at least one of a radially converging inner wall and a radially diverging outer wall along the radial height increase.

In another example of any of the above described centrifugal compressors the at least one of the radial converging inner wall and the radially diverging outer wall is linear.

In another example of any of the above described centrifugal compressors the at least one of the radial converging inner wall and the radially diverging outer wall is curved.

An exemplary method for conditioning a flow in a mixed-flow centrifugal compressor includes reducing a speed of a fluid flow from an impeller section to below subsonic speeds using a plurality of vanes in a first diffuser section, the first diffuser section being fixed relative to an impeller, and further reducing the speed of the fluid flow across a second diffuser portion, the second diffuser portion being freely rotating relative to the impeller.

These and other features of the present invention can be best understood from the following specification and drawings, the following of which is a brief description.

DETAILED DESCRIPTION

Figure 1:
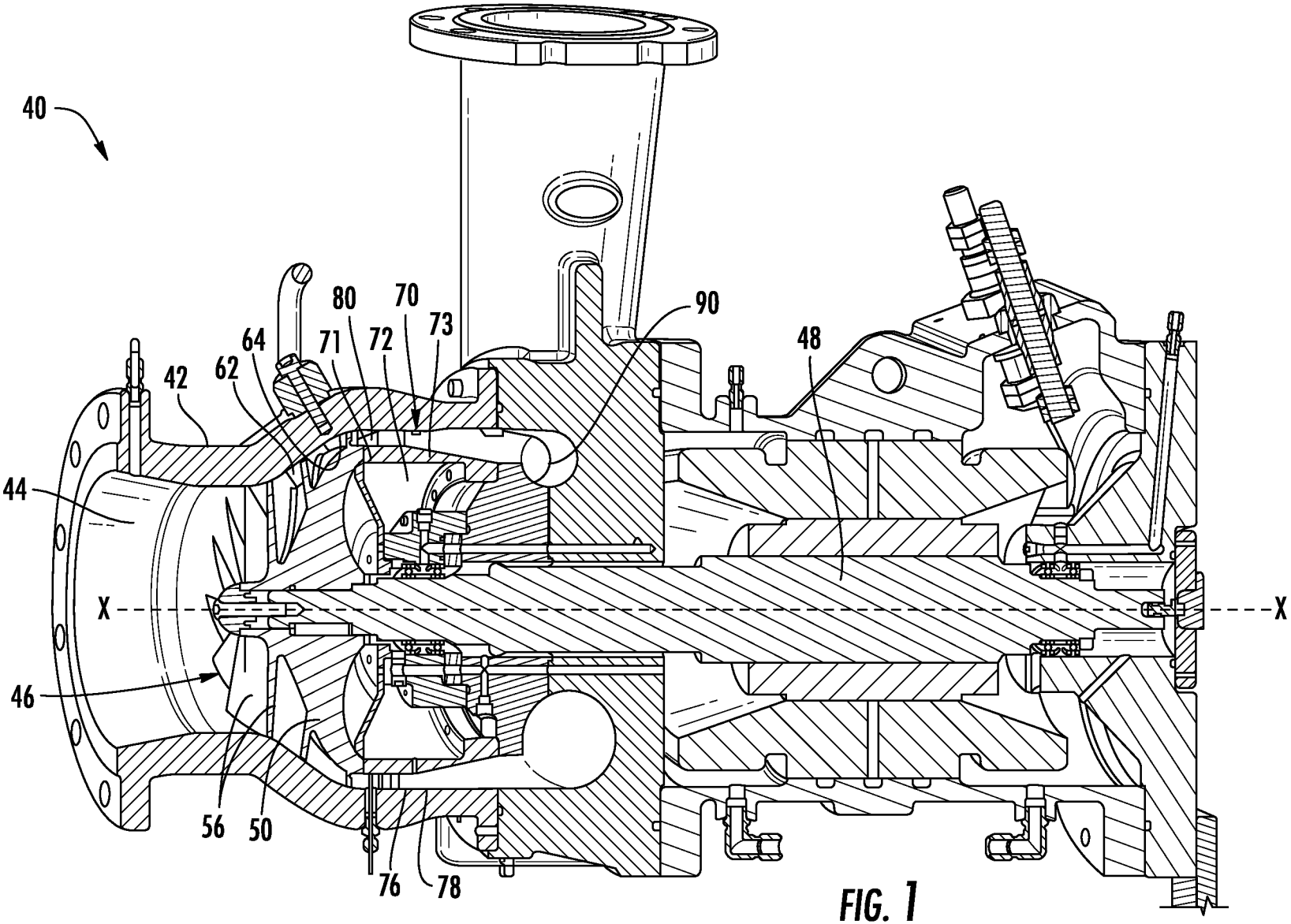
FIG. 1 schematically illustrates a cross section of an exemplary mixed-flow compressor.

FIG. 1 schematically illustrates an example mixed-flow compressor 40. The compressor 40 includes a main casing or housing 42 having an inlet 44 through which a fluid, such as a refrigerant, is directed axially toward a rotating impeller 46. The impeller 46 is secured to a drive shaft 48 such that the impeller 46 is aligned with the axis X of the compressor 40 and rotates along with the shaft 48.

The impeller 46 includes a hub or body 50 having a front side and a back side. The diameter of the front side of the body 50 generally increases toward the back side such that the impeller 46 is conical in shape. A plurality of blades or vanes 56 extends outwardly from the body 50. Each of the plurality of blades 56 is arranged at an angle to the axis of rotation X of the shaft 48 and the impeller 46. In one example, each of the blades 56 extends between the front side and the back side of the impeller 46. Each blade 56 includes a first end arranged generally adjacent a first end of the hub 50 and a second end located generally adjacent the back side of the impeller 46. Further, the second end of the blade 56 is circumferentially offset from the corresponding first end of the blade 56.

Multiple passages 62 are defined between adjacent blades 56 to discharge a fluid passing over the impeller 46 generally parallel to the axis X. As the impeller 46 rotates, fluid approaches the front side of the impeller 46 in a substantially axial direction and flows through the passages 62 defined between adjacent blades 56. Because the passages 62 have both an axial and radial component, the axial flow provided to the front surface of the impeller 46 simultaneously moves both parallel to and circumferentially about the axis of the shaft 48. In combination, the inner surface of the housing 42 and the passages 62 of the impeller 46 cooperate to discharge the compressed refrigerant fluid from the impeller 46. The compressed fluid is discharged from the impeller 46 at any angle relative to the axis X of the shaft 48 into an adjacent diffuser section 70.

Figure 2:
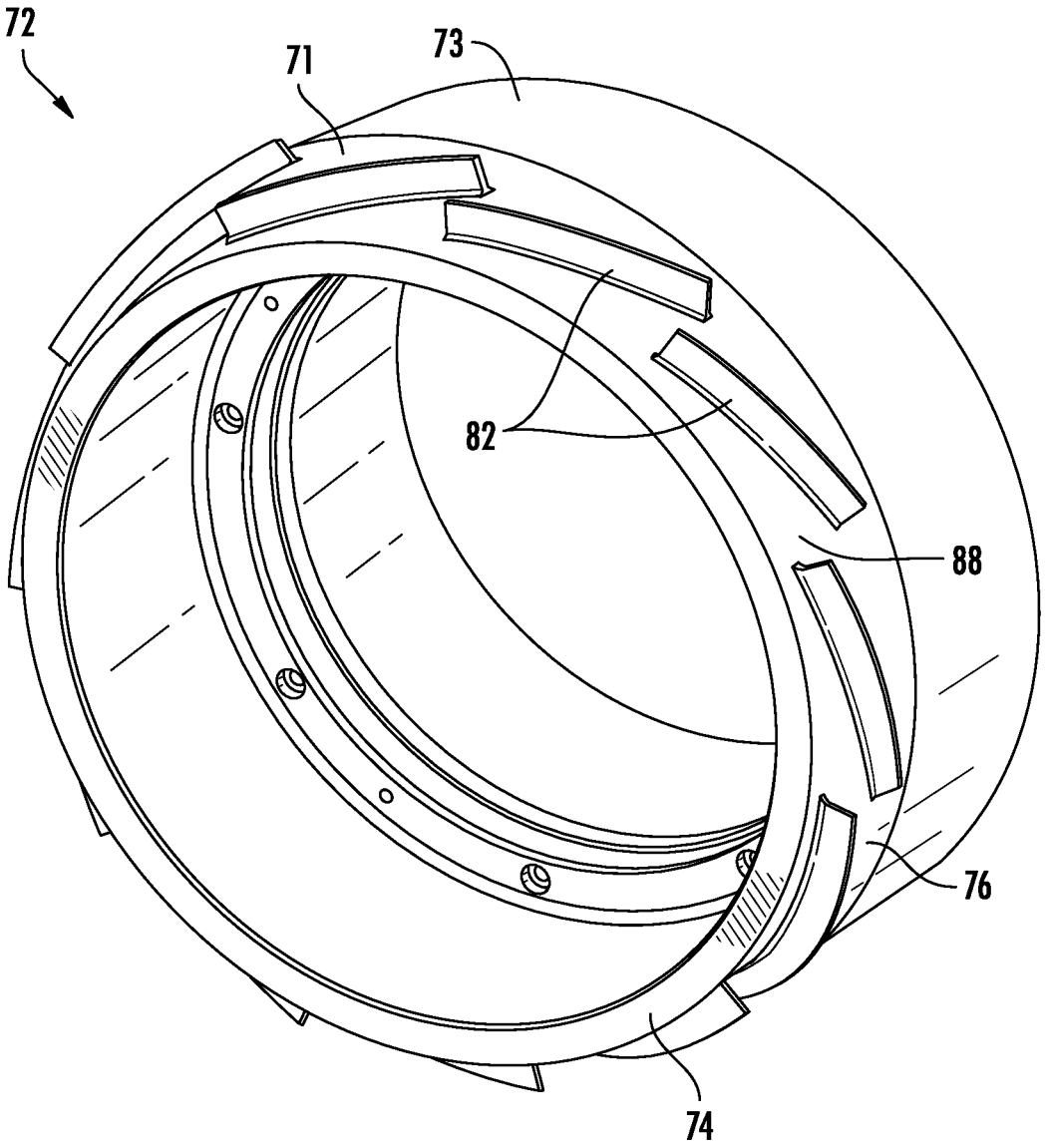
FIG. 2 schematically illustrates a diffuser section of the mixed-flow compressor of FIG. 1 according to a first example.

With continued reference to FIG. 1, FIG. 2 schematically illustrates an isometric view of an exemplary diffuser section 70. The diffuser section 70 includes a diffuser structure 72 mounted generally circumferentially about the shaft 48, at a location downstream from the impeller 46 relative to the direction of flow through the compressor 40. When the diffuser structure 72 is mounted within the compressor 40, a first end 74 of the diffuser structure 72 may directly abut the hack side of the impeller 46. In alternative examples, a clearance may be included between the back side of the impeller 46 and the diffuser 70. Further, the diffuser structure 72 may be mounted such that an outer surface 76 thereof is substantially flush with the front surface 52 of the impeller 46 at the interface with the hack surface.

The diffuser structure 72 includes a forward portion 71 including a set of vanes 82 protruding radially outward from the forward portion 71. The forward portion 71 is fixed relative to the shaft 48 and rotates along with the shaft 48.

A set of circumferentially spaced vanes 82 is affixed about the outer surface 76, and extends radially outward from, the outer surface 76 in the forward portion 71. The plurality of vanes 82 are substantially identical to each other in one example. Alternatively, the vanes 82 vary in size and/or shape in another example. The plurality of vanes 82 are oriented at an angle to the axis of rotation X of the shaft 48.

In addition, the diffuser structure 72 includes a second aft portion 73. The aft portion 73 is not statically fixed to the forward portion 71, and is allowed to freely rotate relative to the shaft 48. The illustrated second portion omits vanes entirely, resulting in a diffuser 70 with only a single set of vanes 82. In other examples, the freely rotating portion of the diffuser 72 can also include a set of vanes. The free rotation of the aft portion 73 is supported via any conventional hearing structure according to known techniques. In yet further examples, the aft portion 73 of the diffuser structure 72 can be fixed relative to the forward portion 71.

As the refrigerant passes through the passageways 88 defined between adjacent vanes 82 of the diffuser structure 72, the kinetic energy of the refrigerant is converted to a potential energy or static pressure, which reduces the speed of the fluid to subsonic conditions. In one embodiment, the configuration of the vanes 82 is selected to reduce a Mach number of the fluid flow, such as by up to 50% or more. In another embodiment, inclusion of the vanes 82 reduces the Mach number of the flow from above 1 to between about 0.2 and 0.8. Further, it should be understood that the diffuser structure 72 illustrated and described herein is intended as an example only and that other diffuser structures having an axial flow configuration and arranged in fluid communication with the passages 62 of the impeller 46 are also contemplated herein. The freely rotating portion 73 of the diffuser section 70 receives the now subsonic flow and further conditions the flow to be a conventional flow.

In this configuration, the fluid flow through the compressor 40 smoothly transitions from the impeller 46 to the diffuser section 70. Although the mixed-flow impeller illustrated and described herein is unshrouded, embodiments including a shroud is disposed circumferentially about the impeller 46 are also within the scope of the disclosure.

Figure 3A:
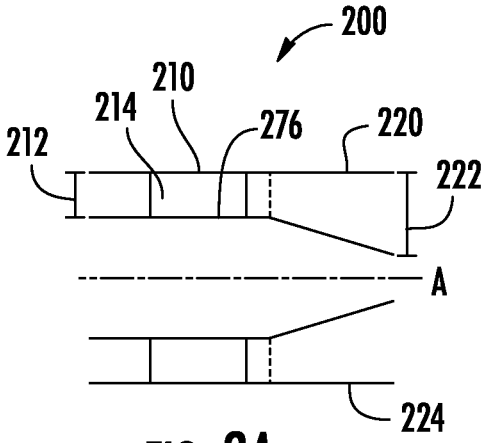
FIG. 3A schematically illustrates a first diffuser portion for a mixed-flow compressor.
Figure 3B:
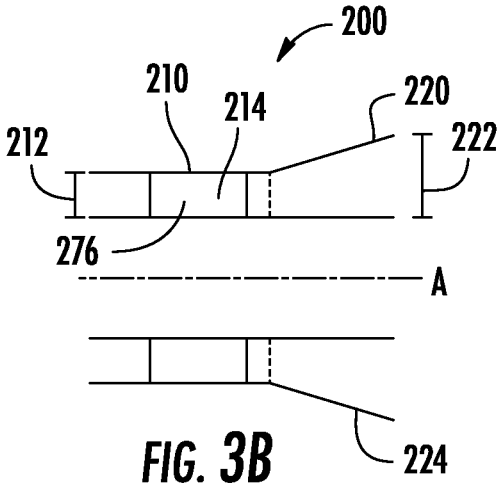
FIG. 3B schematically illustrates a second diffuser portion for a mixed-flow compressor.
Figure 3C:
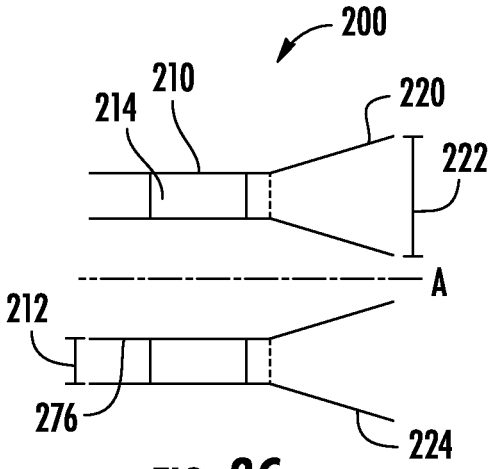
FIG. 3C schematically illustrates a third diffuser combining features of the first diffuser and the second diffuser of FIGS. 3A and 3B in a single example.

In the example of FIG. 1, the outer surface 76 of the diffuser structure 72 converges radially inward toward the axis of rotation X of the shaft 48 as the flow travels downstream. In another configuration, the outer surface 76 can extend parallel, while divergence in the diffuser 70 is achieved via the interior surface 78 of the casing 42 diverging radially outward. In such embodiments, an axial flow channel 80 configured to receive the fluid discharged from the impeller 46 is defined between the outer surface 76 and the casing 42. The convergence and/or divergence is illustrated in FIGS. 3A, 3B and 3C and is described in greater detail below. The divergence and/or convergence occurs in the freely rotating second portion 73 of the diffuser structure 72. The combination of the diffuser structure increasing in radial height due to the divergence and/or convergence and the free rotation of the second portion 73 operates to condition the flow to be a conventional subsonic flow.

With continued reference to FIGS. 1 and 2, FIGS. 3A-3C schematically illustrate exemplary diffuser sections 200 such as can be utilized in the embodiment of FIGS. 1 and 2. Each of the diffuser sections 200 is defined by a fixed portion 210 and a freely rotating portion 220. A radial height 212 of the fixed portion remains constant along an axis A, and a vane 214 extends radially outward from an outer surface 276 of the diffuser structure 72 (illustrated in FIGS. 1 and 2). A radial height 222 of the freely rotating portion 220 increases as the fluid travels downstream. In the illustrated example of FIGS. 3A, 3B and 3C the radial height 222 increase at a constant rate due to a convergence or divergence in the freely rotating portion 220 being linear. In alternative examples, the rate of change of the radial height 222 can be non-constant due to a curved surface at the freely rotating portion 220.

Referring to FIG. 3A, the outer surface 276 of the diffuser structure 72 converges radially inward toward the axis A across the freely rotating portion 220, while the case structure 224 remains at a constant radial position relative to the axis A. Referring to FIG. 3B, the case structure 224 diverges away from the axis A across the freely rotating portion 220, while the outer surface 276 of the diffuser structure 72 remains at a constant radial position relative to the axis A. Each of the examples of FIGS. 3A and 3B provide approximately the same diffusion across the freely rotating section 220. In examples where additional diffusion is desired or required, both a convergence of the outer surface 276 of the diffuser structure 72 and a divergence of the case structure 224 can be included. Such a structure is illustrated at FIG. 3C.

While illustrated in the exemplary embodiments of FIGS. 3A-3C as increasing across the entirety of the freely rotating portion 220, it is appreciated that in some examples, the radial height 212 will not begin increasing until fluid has traveled partially through the freely rotating portion. It is further appreciated that alternative examples can be constructed where a downstream most portion of the freely rotation portion 220 exhibits a constant radial height, and the radial height increase occurs at an upstream portion.

Figure 4:
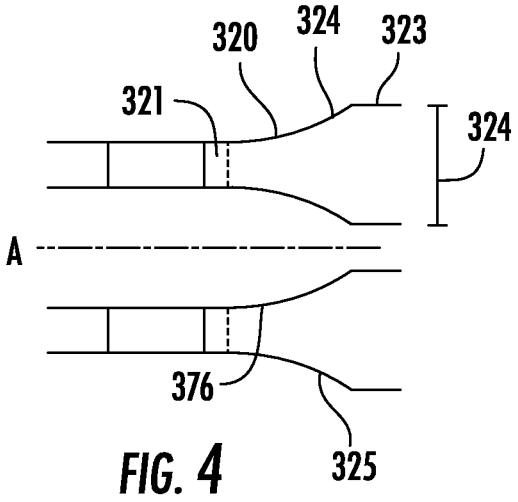
FIG. 4 schematically illustrates a fourth diffuser portion for a mixed-flow compressor.

FIG. 4 illustrates yet a further example including a freely rotating portion 320 where an upstream most end 321 includes a constant radial height 324 and a downstream end 323 includes a constant radial height 324. In the example of FIG. 4, a middle portion 325 converges and diverges along a curvature, causing the radial height 324 to increase as the flow travels downstream. It is appreciated that a similar embodiment can be created utilizing a constant radial position of either the case structure 324 or the outer surface 376 of the diffuser structure 374.

The inclusion of the freely rotating diffuser sections described above can increase the stage efficiency of the mixed flow compressor by reducing the shear stress and related losses on the rotating walls. The particular embodiment or variation of the freely rotating diffuser structure can be selected according to the packaging and diffusing needs of a given mixed-flow compressor and mixed-flow compressor application.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A centrifugal compressor comprising:

a casing;

an impeller arranged within the casing, the impeller being rotatable about an axis and including an axially aligned outlet, the axially aligned outlet being configured such that fluid flows through the axially aligned outlet in an axial direction; and a diffuser section arranged within the casing, the diffuser section being positioned axially downstream from the axially aligned outlet of the impeller, and including a forward portion fixed relative to the impeller and an aft portion, distinct from the forward portion, and wherein a radial height of the diffuser section is constant along the forward portion of the diffuser section.

2. The centrifugal compressor of claim 1, wherein a radially inward boundary of the forward portion of the diffuser section includes a set of vanes protruding radially outward, and being configured to reduce a flow from supersonic to subsonic speeds.

3. The centrifugal compressor of claim 2, wherein the set of vanes are configured to reduce a Mach number of the flow by at least 50%.

4. The centrifugal compressor of claim 2, wherein the set of vanes are configured to reduce the Mach number to a number in the range of 0.4 to 0.8 Mach.

5. The centrifugal compressor of claim 1, wherein the aft portion is defined by an absence of vanes.

6. The centrifugal compressor of claim 1, wherein a radial height of the diffuser section increases along at least a portion of the aft portion.

7. The centrifugal compressor of claim 6, wherein a radially inner wall of the diffuser section converges toward an axis defined by the diffuser section along at least a portion of the aft portion.

8. The centrifugal compressor of claim 7, wherein a radially outer wall of the diffuser section diverges away from the axis defined by the diffuser section along the portion of the aft portion.

9. The centrifugal compressor of claim 6, wherein a radially outer wall of the diffuser section diverges away from the axis defined by the diffuser section along the portion of the aft portion.

10. The centrifugal compressor of claim 6, wherein the radial height increases along at least the portion of the aft portion at a constant rate.

11. The centrifugal compressor of claim 6, wherein the radial height increases along at least the portion of the aft portion at a varying rate.

12. The centrifugal compressor of claim 1, wherein the centrifugal compressor is a mixed-flow compressor.

13. The centrifugal compressor of claim 1, wherein the aft portion is a freely rotating component relative to the forward portion.

14. The centrifugal compressor of claim 1, wherein the aft portion is a fixed component relative to the forward portion.

15. The centrifugal compressor of claim 1, wherein the axially aligned outlet is aligned with the entirety of the diffuser section.

16. A centrifugal compressor comprising:

a casing;

an impeller arranged within the casing, the impeller being rotatable about an axis and including an axially aligned outlet, the axially aligned outlet being configured such that fluid flows through the axially aligned outlet in an axial direction; and a diffuser section arranged within the casing, the diffuser section being positioned axially downstream from the axially aligned outlet of the impeller, and including a forward portion having a constant radial height, and an aft portion having a radial height increasing along a direction of flow.

17. The centrifugal compressor of claim 16, wherein the aft portion includes at least one of a radially converging inner wall and a radially diverging outer wall along the radial height increase.

18. The centrifugal compressor of claim 17, wherein the at least one of the radial converging inner wall and the radially diverging outer wall is linear.

19. The centrifugal compressor of claim 17, wherein the at least one of the radial converging inner wall and the radially diverging outer wall is curved.

20. A method for conditioning a flow in a mixed-flow centrifugal compressor according to claim 16 comprising:

reducing a speed of a fluid flow from an impeller section to below subsonic speeds using a plurality of vanes in a first diffuser section, the first diffuser section being fixed relative to an impeller; and further reducing the speed of the fluid flow across a second diffuser portion, the second diffuser portion being freely rotating relative to the impeller.

* * * * *